US010597203B1

(12) United States Patent
Chang

(10) Patent No.: US 10,597,203 B1
(45) Date of Patent: Mar. 24, 2020

(54) CONTAINER

(71) Applicant: MERRY ELECTRONICS (SHENZHEN) CO., LTD., Guangdong (CN)

(72) Inventor: Hsiang-Sen Chang, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 16/258,659

(22) Filed: Jan. 27, 2019

(30) Foreign Application Priority Data

Sep. 21, 2018 (TW) ..... 107133475 A

(51) Int. Cl.
*B65D 43/24* (2006.01)
*B65D 43/16* (2006.01)

(52) U.S. Cl.
CPC ..... *B65D 43/163* (2013.01)

(58) Field of Classification Search
CPC ..... B65D 43/22; B65D 43/24; B65D 43/163
USPC ..... 220/324, 827, 829, 831, 832, 835, 844
See application file for complete search history.

(56) References Cited

U.S. PATENT DOCUMENTS 799,844 A * 9/1905 Fuller ..... A24F 27/10 206/134
2,605,545 A * 8/1952 Weems ..... B26B 5/00 30/337
2,732,972 A * 1/1956 Anschicks ..... B65D 43/167 220/88.1
4,114,236 A * 9/1978 Vandervort ..... E05D 11/105 16/335
6,092,690 A * 7/2000 Bitowft ..... B65D 43/24 206/494
6,315,144 B1 * 11/2001 Foltz ..... B60K 15/0406 220/255
7,604,142 B2 * 10/2009 Banik ..... A45D 40/221 220/250
7,770,749 B2 * 8/2010 Lin ..... B65F 1/1607 220/254.5
8,910,783 B2 * 12/2014 Liu ..... A24F 15/12 206/266
9,302,825 B2 * 4/2016 Liu ..... B65D 43/163
9,867,396 B2 * 1/2018 Liu ..... A24F 15/12

* cited by examiner

*Primary Examiner* — J. Gregory Pickett
*Assistant Examiner* — Niki M Eloshway
(74) *Attorney, Agent, or Firm* — CKC & Partners Co., LLC

(57) ABSTRACT

A container includes a first cover, a second cover, a rotating shaft, an acting element, and the multiple bending elastic piece. The rotating shaft is engaged between the first cover and the second cover, such that the first cover and the second cover are rotatable relative to each other. The acting element is connected to the rotating shaft. The multiple bending elastic piece includes a fixing portion and an interfering portion. The fixing portion is fixed to the first cover. The interfering portion is located between the fixing portion and the rotating shaft. While the rotating shaft is rotated relative to the first cover, the acting element changes a bending degree of the multiple bending elastic piece with the rotation of the rotating shaft, thereby enabling the interfering portion to selectively contact opposite sides of the acting portion.

10 Claims, 13 Drawing Sheets

A-A

18 { 180, 182, 184 }
182 { 1820, 1822, 1824 }
184 { 1840, 1842, 1844 }

CONTAINER

CROSS-REFERENCE TO RELATED APPLICATION

This application claims priority to Taiwan Application Serial Number 107133475, filed Sep. 21, 2018, which is herein incorporated by reference in its entirety.

BACKGROUND

Field of Invention

The present invention relates to a container.

Description of Related Art

Each of various conventional containers is basically composed of an upper cover and a box. The upper cover and the box are usually produced by a plastic injection molding process or by a metal stamping process. Furthermore, the upper cover and the box can be connected by means of a hinge connection.

In addition, the upper cover and the box of the container are generally provided with plastic bumps respectively. When the upper cover is opened relative to the box, the plastic bumps resist against each other to prevent the upper cover from being overly unfolded relative to the box. Further, if the upper cover is being shaken, the upper cover tends to cover the box. Therefore, a torsion spring is often disposed between the upper cover and the box of the container to provide a torsion force to resist and prevent the upper cover from covering the box due to being shaken.

However, the plastic bumps placed on the upper cover and the box are likely to be worn out after a long term of operation, and lose their functions. Relatively, when the upper cover covers the box, the torsion spring disposed between the upper cover and the box may cause the upper cover to collide with the box due to too much force exerted thereon, thus further causing the contents in the container to be damaged by vibration.

SUMMARY

The invention provides a container.

In some embodiments, the container includes a first cover, a second cover, a rotating shaft, an acting element, and the multiple bending elastic piece. The rotating shaft is engaged between the first cover and the second cover, such that the first cover and the second cover are rotatable relative to each other. The acting element is connected to the rotating shaft. The multiple bending elastic piece includes a fixing portion and an interfering portion. The fixing portion is fixed to the first cover. The interfering portion is located between the fixing portion and the rotating shaft. While the rotating shaft is rotating relative to the first cover, the acting element changes a bending degree of the multiple bending elastic piece with the rotation of the rotating shaft, thereby enabling the interfering portion to selectively contact opposite sides of the acting portion.

In some embodiments, each of the opposite sides of the acting portion has at least two adjacent planes. The at least two planes at one of the opposite sides of the acting portion are symmetric to the at least two planes at the other of the opposite sides of the acting portion respectively.

In some embodiments, the adjacent planes intersect at an angle in a range from about 60 degrees to about 120 degrees.

In some embodiments, the interfering portion includes a first elastic segment and a second elastic segment connected to the first elastic segment. The first elastic segment extends from the fixing portion to the rotating shaft. The second elastic segment is folded away from an end of the first elastic segment near the rotating shaft and extends away from the rotating shaft.

In some embodiments, the first elastic segment and the second elastic segment form a V-shaped profile.

In some embodiments, the interfering portion further includes a turning corner connected between the first elastic segment and the second elastic segment.

In some embodiments, the container further includes a limiting plate covering the acting portion and the interfering portion.

In some embodiments, the multiple bending elastic piece includes an abutting portion connected to the interfering portion and closer to the limiting plate than the interfering portion.

In some embodiments, the container further includes a buffering layer disposed on the abutting portion and located between the abutting portion and the limiting plate.

In some embodiments, the buffering layer has an opening that exposes a part of the interfering portion.

In some embodiments, the container further includes a buffering layer disposed on the limiting plate and located between the abutting portion and the limiting plate.

In some embodiments, the container further includes a protecting layer disposed on the interfering portion and located between the interfering and the acting portion.

In some embodiments, the protecting layer has an opening that exposes a part of the interfering portion.

It is to be understood that both the foregoing general description and the following detailed description are by examples, and are intended to provide further explanation of the invention as claimed.

In the aforementioned configurations, a multiple bending elastic piece in the container is not deformed when the container is not opened. At this time, the acting portion is interposed between the first elastic segment and the second limiting plate of the multiple bending, thereby restricting rotation of a rotating shaft relative to a first cover. Hence, a second cover is positioned at a cover position with respect to the first cover.

When the acting portion rotates toward the second limiting plate, the interfering portion of the multiple bending elastic piece presses the acting portion to make the acting portion automatically rotate toward the second limiting plate, thereby driving the rotating shaft to rotate, such that the second cover connected to the rotating shaft in the container can be automatically opened relative to the first cover. Furthermore, when the second cover of the container is rotated to be opened relative to the first cover, the interfering portion presses the acting portion, such that the acting portion is sandwiched between the second elastic segment of the multiple bending elastic piece and the second limiting plate, thereby limiting the rotation of the rotating shaft relative to the first cover. Hence, the second cover connected to the rotating shaft is positioned at the open position relative to the first cover body.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
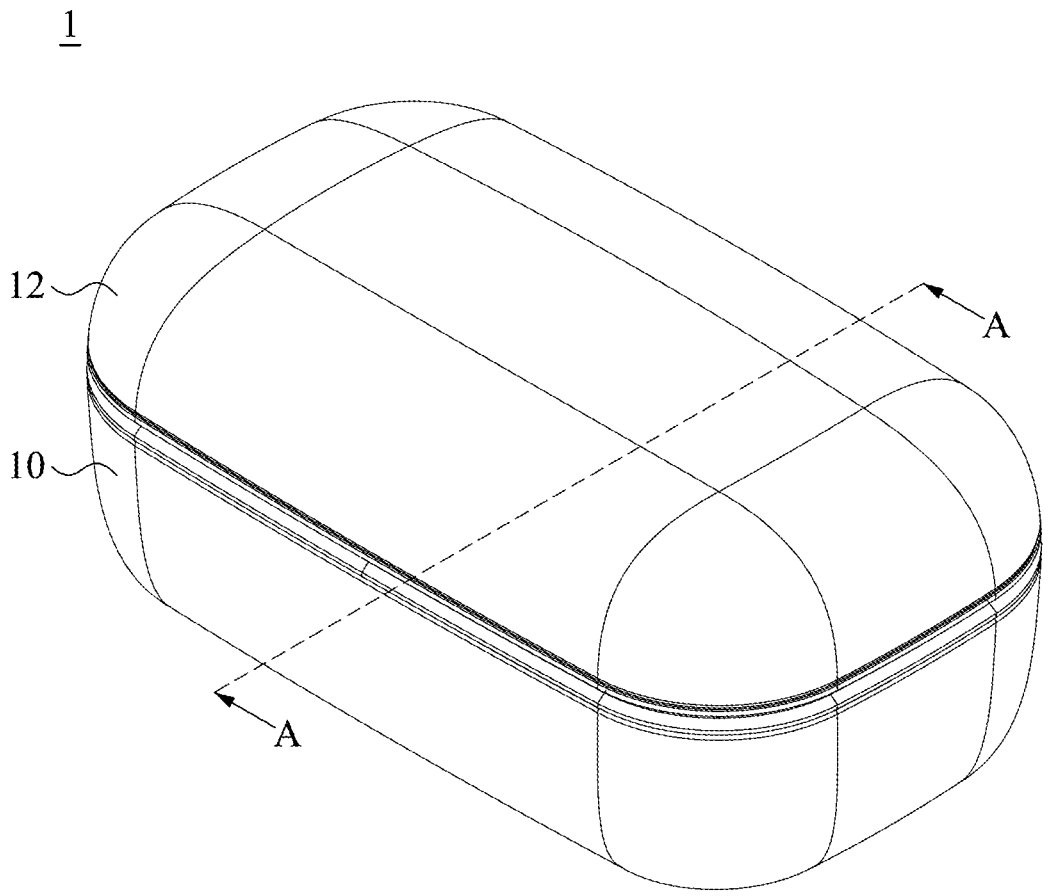
FIG. 1A illustrates a perspective view of a container according to some embodiments of the present disclosure, in which a second cover covers a first cover.

Reference will now be made in detail to the present embodiments of the invention, examples of which are illustrated in the accompanying drawings. Wherever possible, the same reference numbers are used in the drawings and the description to refer to the same or like parts.

Figure 1B:
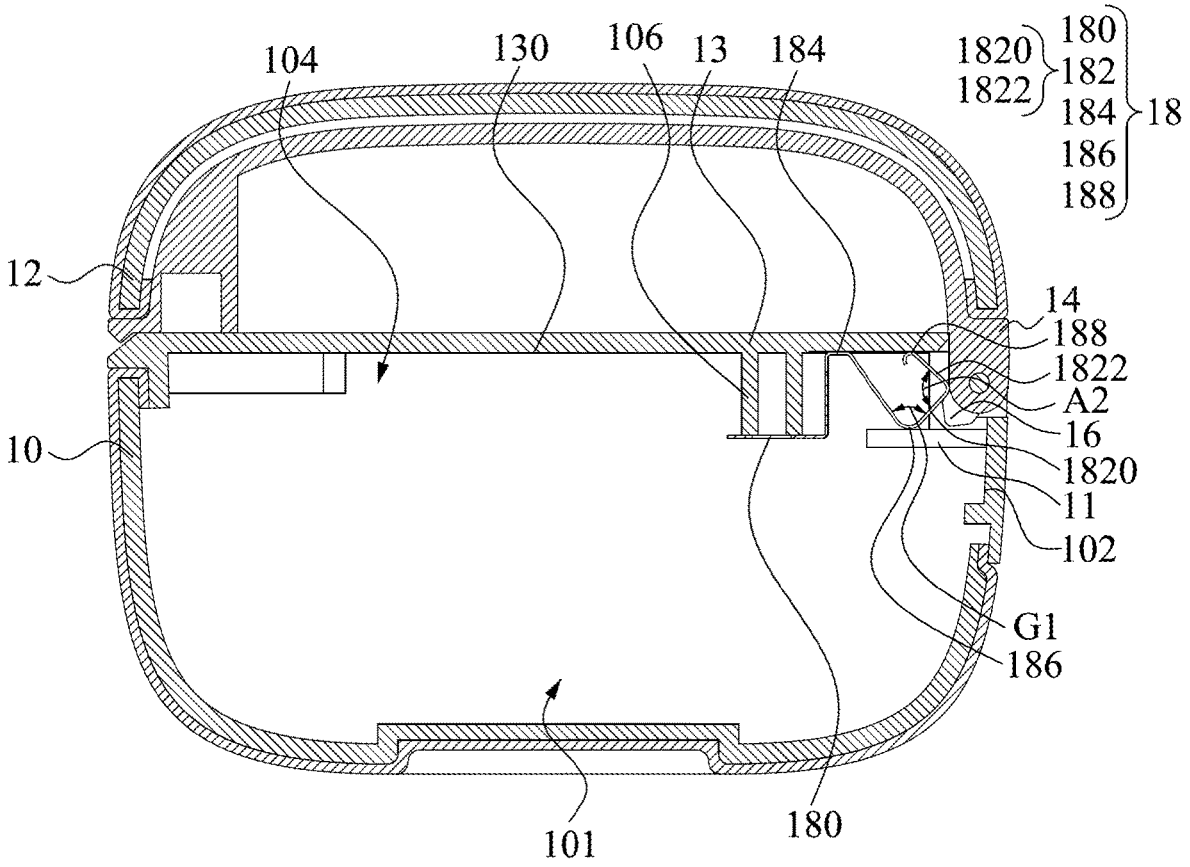
FIG. 1B is a cross-sectional view viewed along line A-A in FIG. 1A.

Reference is made to FIG. 1A and FIG. 1B. FIG. 1A illustrates a perspective view of a container 1 according to some embodiments of the present disclosure, in which the second cover 12 covers the first cover 10. FIG. 1B is a cross-sectional view of the container 1 viewed along line A-A in FIG. 1A. As shown in FIG. 1A and FIG. 1B, in some embodiments, the container 1 includes the first cover 10, the second cover 12, a rotating shaft 14, an acting portion 16 disposed on the rotating shaft 14, a multiple bending elastic piece 18 located in the first cover 10, a first limiting plate 11, and a second limiting plate 13. The structures and functions of the elements and the relationship therebetween are described in detail hereinafter.

Figure 2A:
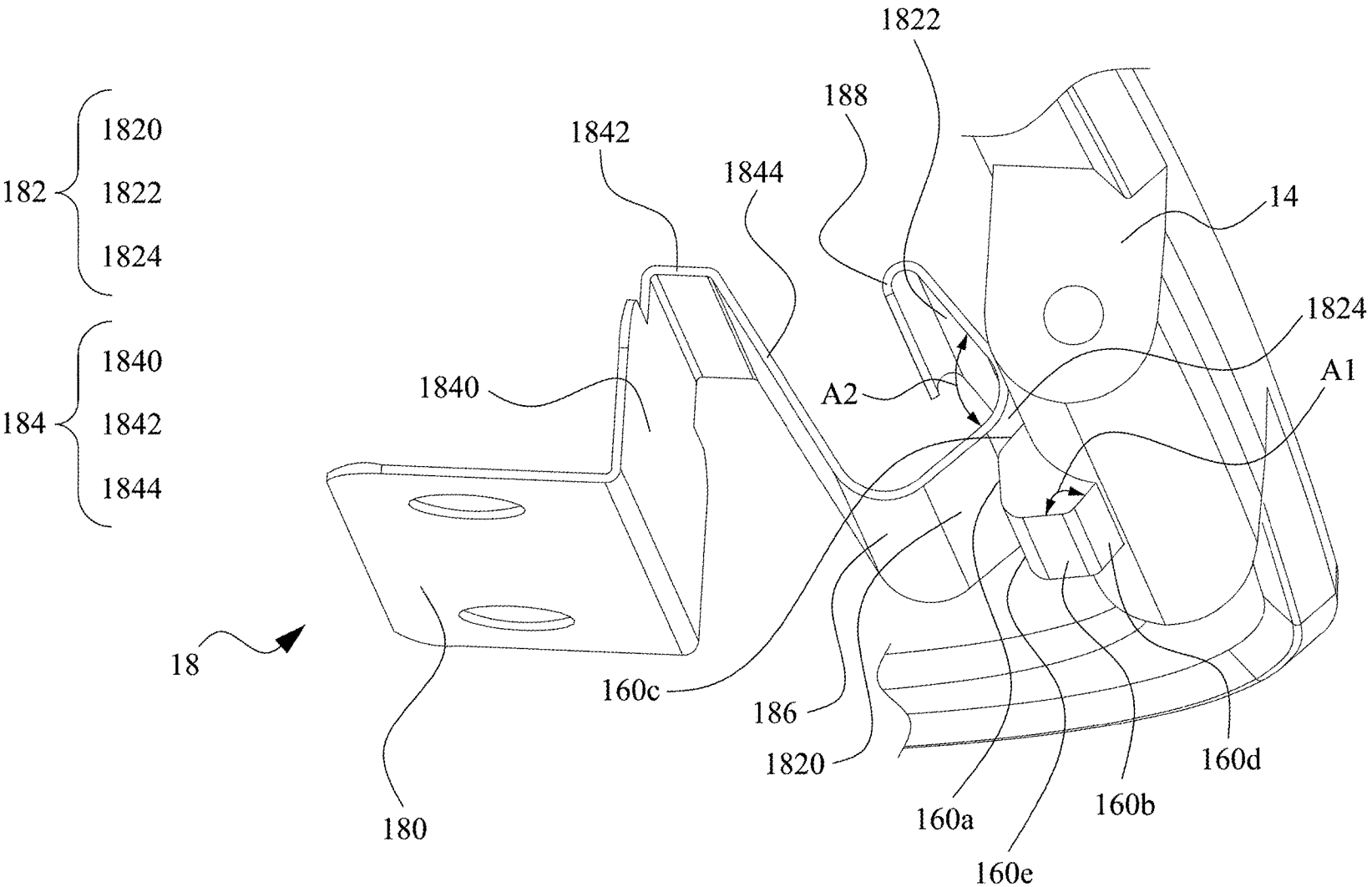
FIG. 2A illustrates a top perspective view showing a rotating shaft, an acting portion, and a multiple bending elastic piece according to some embodiments of the present disclosure.
Figure 2B:
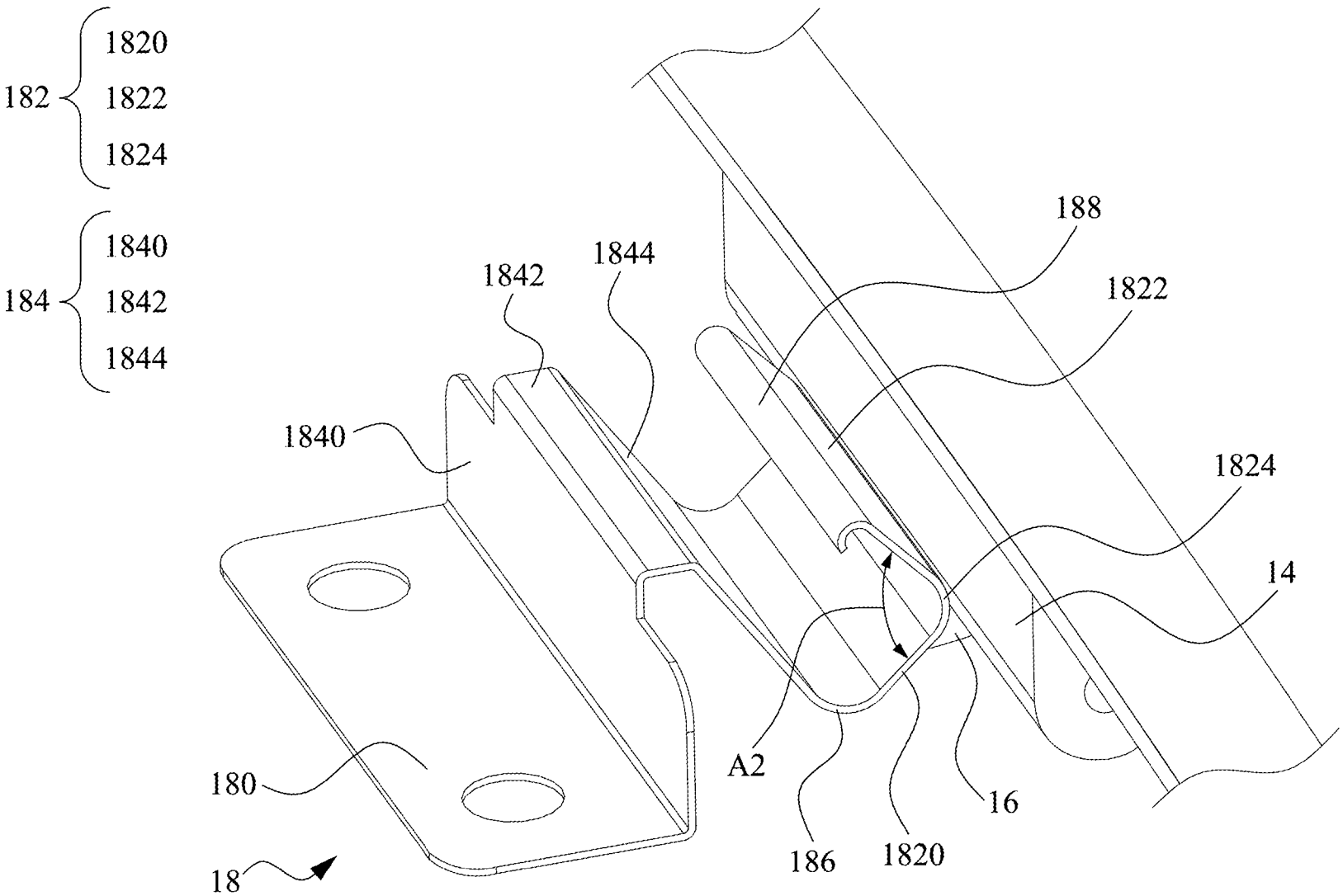
FIG. 2B illustrates a bottom perspective view showing the rotating shaft, the acting portion, and the multiple bending elastic piece according to some embodiments of the present disclosure.
Figure 2C:
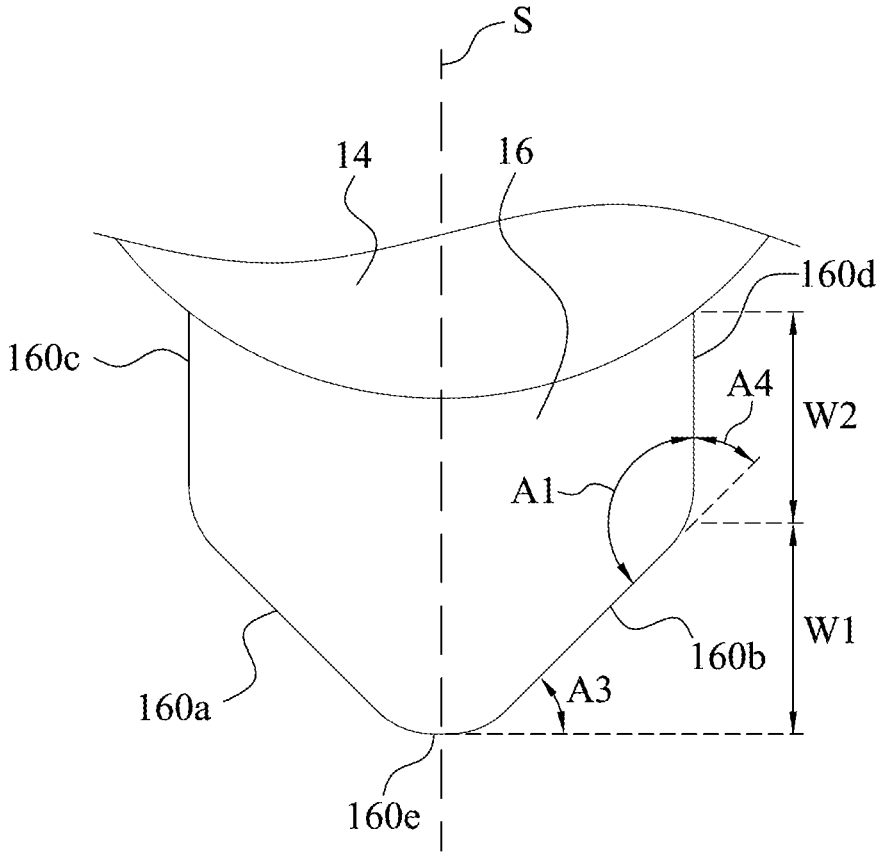
FIG. 2C illustrates a side view of portions of the rotating shaft and the acting portion according to some embodiments of the present disclosure.

Reference is made to FIG. 1B, FIG. 2A, FIG. 2B, and FIG. 2C. FIG. 2A illustrates a top perspective view showing the rotating shaft 14, the acting portion 16, and a multiple bending elastic piece 18 according to some embodiments of the present disclosure. FIG. 2B illustrates a bottom perspective view showing the rotating shaft 14, the acting portion 16, and multiple bending elastic piece 18 according to some embodiments of the present disclosure. FIG. 2C illustrates a side view of portions of the rotating shaft 14 and the acting portion 16 according to some embodiments of the present disclosure.

As shown in FIG. 1B, the rotating shaft is connected the second cover 12, and is engaged between the first cover 10 and the second cover 12, such that the first cover 10 and the second cover 12 are rotatable relative to each other. Specifically, the first cover has an accommodating space 101. The first limiting plate 11 is located in the accommodating space 101 of the first cover and below the rotating shaft 14, and protrudes from an inner wall 102 of the first cover 10. The first limiting plate 11 covers the acting portion 16 and an interfering portion 182 of the multiple bending elastic piece 18. Furthermore, the second limiting plate 13 covers an opening 104 of the first cover 10 and is connected to an end surface of the 104, and further covers the acting portion 16 and the interfering portion 182 of the multiple bending elastic piece 18. In other words, the acting portion 16 and the interfering portion 182 of the multiple bending elastic piece 18 are located between the first limiting plate 11 and the second limiting plate 13.

As shown in FIG. 1B, the acting portion 16 is connected to the rotating shaft 14 and is located in the first cover 10. The acting portion 16 is a tapered structure, but the present is not limited thereto. As shown in FIG. 2C, a side of the acting portion 16 has adjacent planes 160*a* and 160*c*. Another side of the acting portion 16 has adjacent planes 160*b* and 160*d*. The acting portion 16 has a turning corner 160*e* connected between the planes 160*a* and 160*b*. In the embodiment, a virtual extension surface S passes through a rotation center line of the rotating shaft 14 and is orthogonal to the turning corner 160*e* of the acting portion 16. The planes 160*a* and 160*b* of the acting portion 16 are substantially symmetrical to the virtual extension plane S and the planes 160*c* and 160*d* of the acting portion 16 are substantially symmetrical to the virtual extension plane S.

Furthermore, the two adjacent planes 160*a* and 160*c* of the acting portion 16 form an angle A1 therebetween (See FIG. 2C). That is, the two adjacent planes 160*a* and 160*c* of the acting portion 16 have an angle A4 (See FIG. 2C) complementary to the angle A1. Similarly, the two adjacent planes 160*b* and 160*d* of the acting portion 16 form an angle A1 therebetween. Furthermore, the plane 160*b* of the acting portion 16 and a plane orthogonal to the virtual extension surface S intersect at an angle A3. Similarly, the plane 160*a* of the acting portion 16 and the plane orthogonal to the virtual extension surface S intersect at an angle A3. In the embodiment, the angle A3 is substantially equal to the angle A4. For example, both the angle A3 and the angle A4 are about 45 degrees, but the present disclosure is not limited thereto.

As shown in FIG. 2C, in a direction along the virtual extension surface S, the planes 160*d* and 160*b* of the acting portion 16 have widths W1 and W2 respectively. In the embodiment, the width W1 of the plane 160*d* of the acting portion 16 is substantially equal to the width W2 of the plane 160*b* of the acting portion 16. For example, both the width W1 of the plane 160*d* and the width W2 of the plane 160*b* are about 0.7 mm, but the present disclosure is not limited thereto.

As shown in FIG. 1B, the multiple bending elastic piece 18 includes a fixing portion 180, a leaning portion 184, an abutting portion 186, the interfering portion 182, and an abutting portion 188. In the embodiment, the first cover further includes a supporting column 106. The supporting column 106 of the first cover 10 is connected to a surface 130 of the second limiting plate 13 facing the accommodating space 101. The fixing portion 180 of the multiple bending elastic piece 18 is fixed to the supporting column 106 of the first cover 10, and is spaced apart from the second limiting plate 13. In the embodiment, the fixing portion 180 is substantially parallel to the surface 130, but the present disclosure is not limited thereto.

As shown in FIG. 2A and FIG. 2B, the leaning portion 184 of the multiple bending elastic piece 18 is formed from an elastic piece that has been bent twice. The leaning portion 184 includes a first extending segment 1840, an abutting segment 1842, and a second extending segment 1844 that are sequentially connected. The first and second extending segments 1840 and 1844 extend from two opposite ends of the abutting segment 1842 substantially toward the same side of the abutting segment 1842. The first extending segment 1840 of the leaning portion 184 is connected to the fixing portion 180, and is substantially perpendicular to the fixing portion 180. The second extending segment and 1844 of the leaning portion 184 is connected to the abutting portion 186. The abutting segment 1842 of the leaning portion 184 is configured to movably resist the surface 130 of the second limiting plate 13 (See FIG. 1B). In the embodiment, the abutting segment 1842 of the leaning portion 184 is substantially a horizontal plate, and is configured to slide on the surface 130 of the second limiting plate 13.

In FIG. 2A and FIG. 2B, the interfering portion 182 of the multiple bending elastic piece 18 is located between the fixing portion 180 and the rotating shaft 14, and includes a first elastic segment 1820, a turning corner 1824, and a second elastic segment 1822 that are sequentially connected.

In the embodiment, the interfering portion 182 of the multiple bending elastic piece 18 extends from the fixing portion 180 to the rotating shaft 14. The second elastic segment 1822 of the interfering portion 182 is folded away from the first elastic segment 1820 near an end of the rotating shaft 14, and extends away from the rotating shaft 14.

In other words, the first elastic segment 1820 and the second elastic segment 1822 of the interfering portion 182 form a V-shaped profile. An opening of the V-shaped profile faces toward the leaning portion 184. The first elastic segment 1820 and the second elastic segment 1822 form an angle A2 therebetween. In the embodiment, the angle is about 90 degrees, but the present disclosure is not limited. The turning corner 1824 of the interfering portion 182 is connected between the first elastic segment 1820 and the second elastic segment 1822, and protrudes away from the leaning portion 184. As shown in FIG. 1B, a height of the interfering portion 182 relative to the first limiting plate 11 is substantially the same as a height of the leaning portion 184 relative to the first limiting plate 11. The first elastic segment 1820 of the interfering portion 182 and the second extending segment 1844 of the leaning portion 184 form an angle G1 therebetween.

In FIG. 2A and FIG. 2B, the abutting portions 186 and 188 are connected to two opposite ends of the interfering portion 182 respectively. The abutting portion 188 protrudes away from the second elastic segment 1822 of the interfering portion 182. Relatively, the abutting portion 188 protrudes away from the first elastic segment 1820 of the interfering portion 182. In the embodiment, the abutting portion 186 is located closer to the limiting plate 11 than the interfering portion 182 (See FIG. 1B), and the abutting portion 188 is located closer to the limiting plate 13 than the interfering portion 182 (See FIG. 1B).

Figure 3:
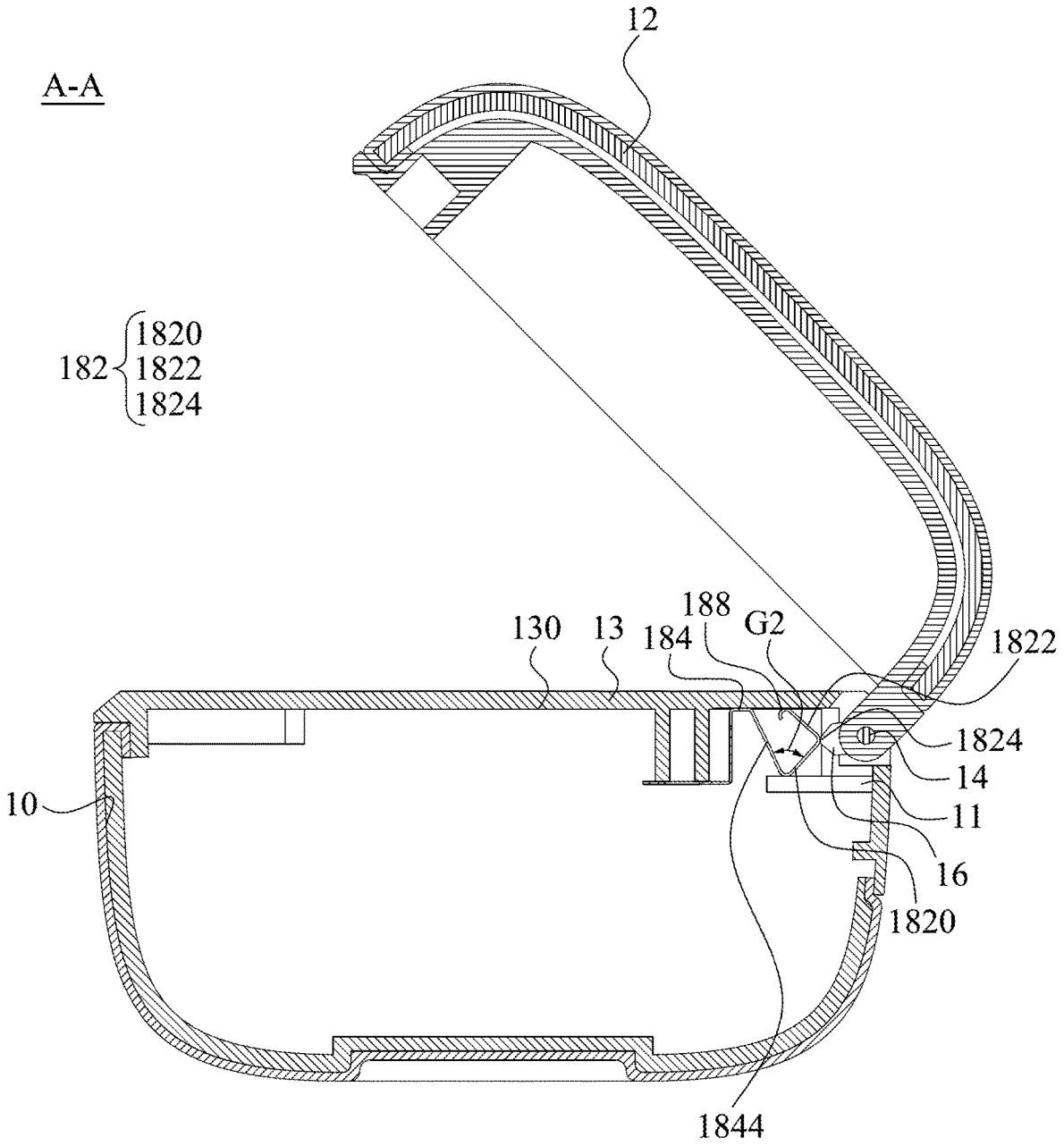
FIG. 3 and FIG. 4 are cross-sectional views of the container at different stages of operation viewed along line A-A in FIG. 1A, in which the second cover in FIG. 3 is opened relative to the first cover at about 45 degrees, and the second cover in FIG. 4 is opened relative to the first cover at about 90 degrees.
Figure 4:
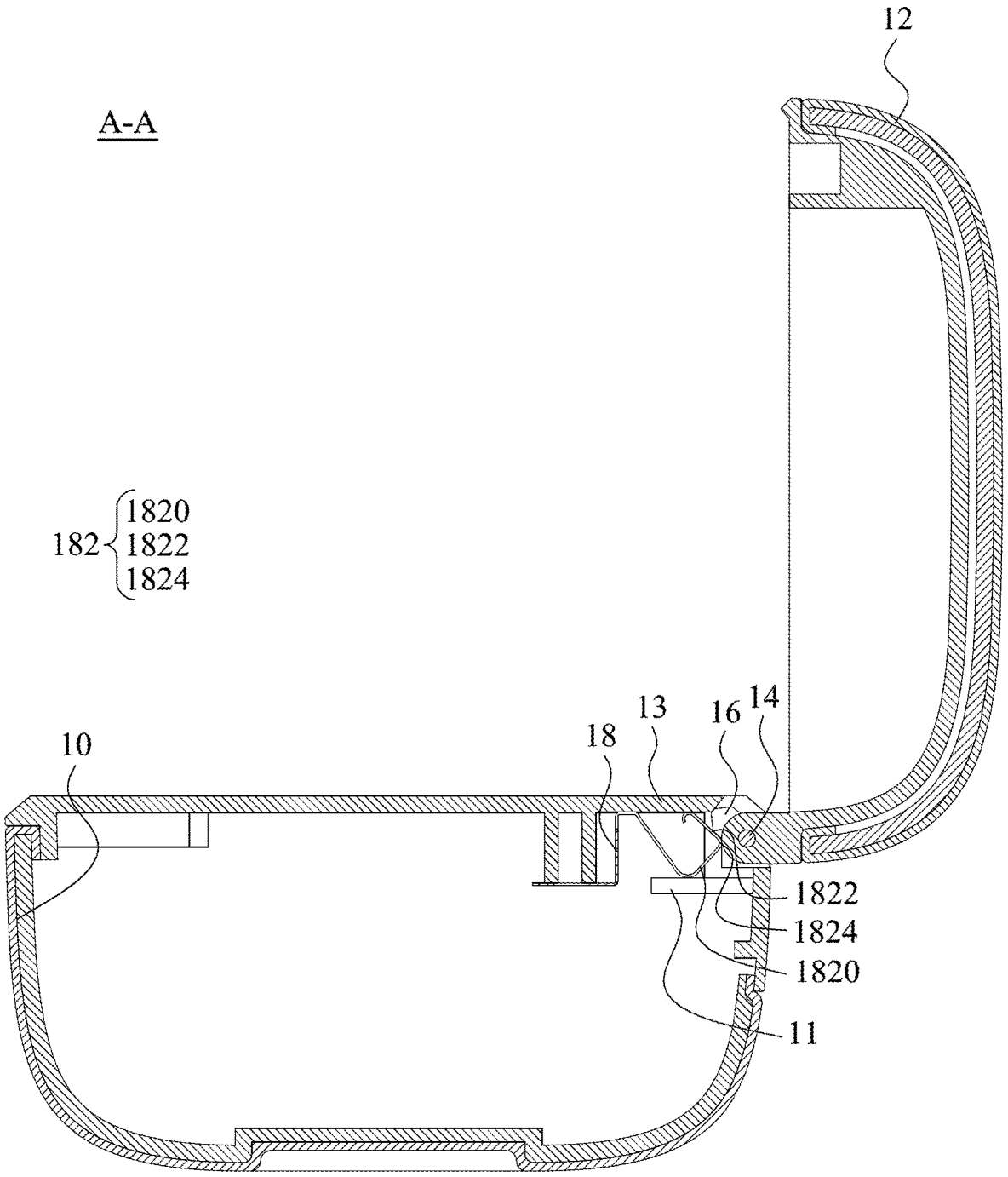

Reference is made to FIG. 1B, FIG. 3, and FIG. 4. FIG. 3 and FIG. 4 are cross-sectional views of the container 1 at different stages of operation viewed along line A-A in FIG. 1A, in which the second cover 12 in FIG. 3 is opened relative to the first cover 10 at about 45 degrees, and the second cover 12 in FIG. 4 is opened relative to the first cover 10 at about 90 degrees.

In FIG. 1B, when the second cover 12 of the container 1 covers the first cover 10, the acting portion 16 is located between the first elastic segment 1820 and the first limiting plate 11. The plane 160*c* of the acting portion (as shown in FIG. 2C) is in contact with the first elastic segment 1820 of the multiple bending elastic piece 18. At this time, the multiple bending elastic piece 18 is substantially not deformed, and the acting portion 16 is interposed between the first elastic segment 1820 of the multiple bending elastic piece 18 and the first limiting plate 11, thereby restricting rotation of the rotating shaft 14 relative to the first cover 10. Therefore, the second cover 12 connected to the rotating shaft 14 is positioned at a position that covers the first cover 10.

In FIG. 3, during the period while the second cover 12 is being opened relative to the first cover 10, the rotating shaft 14 rotates relative to the first cover 10 with the acting portion 16. During the period while the acting portion 16 is rotating relative to the first cover 10, the plane 160*c* (See FIG. 2C) of the acting portion 16 resists the first elastic segment 1820 of the multiple bending elastic piece 1 and changes the degree of bending of the multiple bending elastic pieces 18.

For example, when the plane 160*c* (See FIG. 2C) of the acting portion 16 rotates toward the second limiting plate 13, the plane 160*c* will be pushed against the first elastic segment 1820, such that an angle between the first elastic segment 1820 of the interfering portion 182 and the second extending segment 1844 of the leaning portion 184 will be further bent from the angle G1 to an angle G2, in which the angle G2 is less than the angle G1 shown in FIG. 1B.

At the same time, the abutting portion 188 abuts against the surface 130 of the second limiting plate 13 and moves away from the rotating shaft 14. The leaning portion 184 can be movably resist the surface 130 of the second limiting plate 13 to increase the range of movement of the interfering portion 182 and to provide a recovering capability of the interfering portion 182 thereafter.

Hence, during the rotation of the acting portion 16 relative to the first cover 10, the acting portion 16 presses the interfering portion 182 of the multiple bending elastic piece 18, such that a distance between the interfering portion 182 and the rotating shaft 14 is increased, and thus the acting portion 16 can overcome interference of the multiple bending elastic piece 18 in structural configuration. Then, the acting portion 16 continues to rotate toward the second limiting plate 13 until the acting portion 16 is located at a side of the interfering portion 182 opposite to the first limiting plate 11, such that the plane 160*d* (See FIG. 2C) on the acting portion 16 is in contact with the second elastic segment 1822 of the interfering portion 182.

Specifically, during the rotation of the action portion 16 relative to the first cover 10, the planes 160*c* and 160*a* (See FIG. 2C) on the acting portion 16 sequentially abut against and compress the first elastic segment 1820 of the multiple bending elastic piece 18. When the turning corner 160*e* (See FIG. 2C) on the action portion 16 is in contact with the interfering portion 182, the multiple bending elastic piece 18 has the greatest stress. When the acting portion 16 continues to rotate toward the second limiting plate 13 until the plane 160*b* (See FIG. 2C) is in contact with the multiple bending elastic pieces 18, the interfering portion 182 of the multiple bending elastic piece 18 presses the acting portion 16, such that the planes 160*b* and 160*d* (see FIG. 2C) on the acting portion 16 sequentially abut against the second elastic segment 1822 of the multiple bending elastic piece 18. Therefore, the acting portion 16 automatically rotates toward the second limiting plate 13 to rotate the rotating shaft 14, such that the second cover 12 of the container 1 connected to the rotating shaft 14 can be automatically opened relative to the first cover 10.

In FIG. 4, when the second cover 12 is opened relative to the first cover 10, the interfering portion 182 presses the acting portion 16 until the plane 160*d* of the acting portion 16 (See FIG. 2C) is in contact with the second elastic segment 1822 of the multiple bending elastic piece 18. At this time, the acting portion 16 is interposed between the second elastic segment 1822 and the second limiting plate 13 of the multiple bending elastic piece 18, thereby restricting the rotation of the rotating shaft 14 relative to the first cover 10. Hence, the second cover 12 connected to the rotating shaft 14 is positioned in the open position relative to the first cover 10.

Relatively, when the second cover 12 rotates relative to the first cover 10 to cover the first cover, the rotating shaft 14 connected to the second cover 12 can rotate relative to the first cover 10 and drive the driving action portion 16 to rotate toward the first limiting plate 11. During the rotation of the acting portion 16 relative to the first cover 10, the planes 160*d* and 160*b* (See FIG. 2C) of the acting portion 16 sequentially abut against the second elastic portion 1822 of the multiple bending elastic piece 18, thereby changing the degree of bending of the multiple bending elastic pieces 18, and thus a distance between the interfering portion 182 and the rotating shaft 14 can be increased. When the turning corner 160*e* on the acting portion 16 is in contact with the interfering portion 182, the multiple bending elastic piece 18 has the greatest stress.

At the same time, the abutting portion 186 abuts against the first limiting plate 11 and moves away from the rotating shaft 14. The leaning portion 184 can movably abut against the surface 130 of the second limiting plate 13 to increase the range of movement of the interfering portion 182 and to provide the recovering capability of the interfering portion 182 thereafter.

Then, during the rotation of the acting portion 16 toward the first limiting plate 11, the interfering portion 182 presses the acting portion 16, such that the planes 160*a* and 160*c* (See FIG. 2C) on the acting portion 16 sequentially abut against the first elastic portion 1820 of the multiple bending elastic piece 18, thereby enabling the action portion 16 to overcome the interference of the multiple bending elastic pieces 18 in the structural configuration. Therefore, the acting portion 16 automatically rotates toward the first limiting plate 11 to rotate the rotating shaft 14, such that the second cover 12 of the container 1 connected to the rotating shaft 14 can automatically cover the first cover 10.

Figure 5:
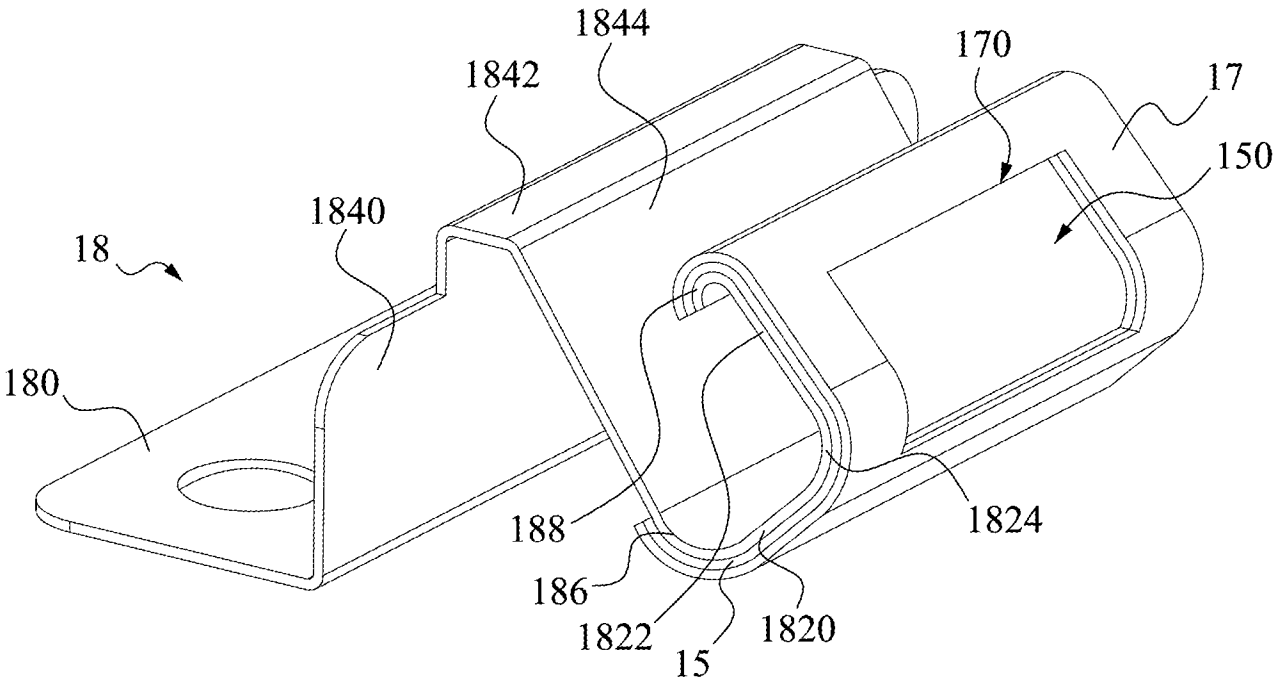
FIG. 5 illustrates a perspective view of the multiple bending elastic piece, a buffering layer, and a protecting layer according to some embodiments of the present disclosure.

Reference is made to FIG. 5. FIG. 5 illustrates a perspective view of the multiple bending elastic piece 18, the buffering layer 15, and the protecting layer 17 according to some embodiments of the present disclosure. As shown in FIG. 5, the container 1 further includes a buffer layer 15 and a protecting layer 17. The buffering layer 15 is at least disposed on the abutting portion 186 and abutting portion 188 of the multiple bending elastic piece 18, and is located between the abutting portion 186 and the first limiting plate 11 (as shown in FIG. 1B). In the embodiment, the buffering layer 15 covers the interfering portion 182. The buffering layer 15 can be used to prevent the abutting portions 186 and 188 from colliding with the first and second limiting plates 11 and 13 and generating noise, thereby improving user's comfort of using the container 1.

In some embodiments, the buffering layer 15 has an opening 150. The opening 150 of the buffering layer 15 exposes portions of the first elastic segment 1820, the turning corner 1824, and the second elastic segment 1822. The opening 150 of the buffering layer 15 can prevent the wrinkles of the buffering layer 15 caused by contacting the acting portion 16 when the acting portion 16 interferes with the interfering portion 182, and thus the buffer effect of the buffering layer 15 can be maintained. In other embodiments, another protective layer may be further attached to the opening 150 to improve the wear out problem caused by the interference between the acting portion 16 and the interfering portion 182, thus increasing the service life of the container 1.

In some embodiments, the buffering layer 15 may include silicone rubber, thermoplastic elastomer, or any other suitable material. For example, the buffering layer 15 may include thermoplastic polyurethane (TPU), but the present disclosure is not limited thereto.

As shown in FIG. 5, the protecting layer 17 is disposed on the interfering portion 182 of the multiple bending elastic piece 18, and is located between the interfering portion 182 and the acting portion 16 (See FIG. 1B). In the embodiment, the protecting layer 17 covers the interfering portion 182, and is disposed on the buffering layer 15. The protecting layer 17 can be used to prevent the wear out problem caused by the interference between the acting portion 16 and the interfering portion 182, thereby increasing the service life of the container 1.

In some embodiments, the protecting layer 17 has an opening 170. The opening 170 of the protecting layer 17 communicates with the opening 150 of the buffering layer 15, and exposes portions of the first elastic segment 1820, the turning corner 1824, and the second elastic segment 1822. The opening 170 of the protecting layer 17 can prevent the wrinkles of the protecting layer 17 caused by contacting the acting portion 16 during the interference between the acting portion 16 and the interference portion 182, and thus the protective effect of the protective layer 17 can be maintained.

In some embodiments, the protecting layer 17 may include polytetrafluoroethylene (PTFE), polyethylene terephthalate (PET), polyoxymethylene (POM), or any other suitable material. For example, the buffering layer 15 may include mylar, but the present disclosure is not limited thereto.

Figure 6:
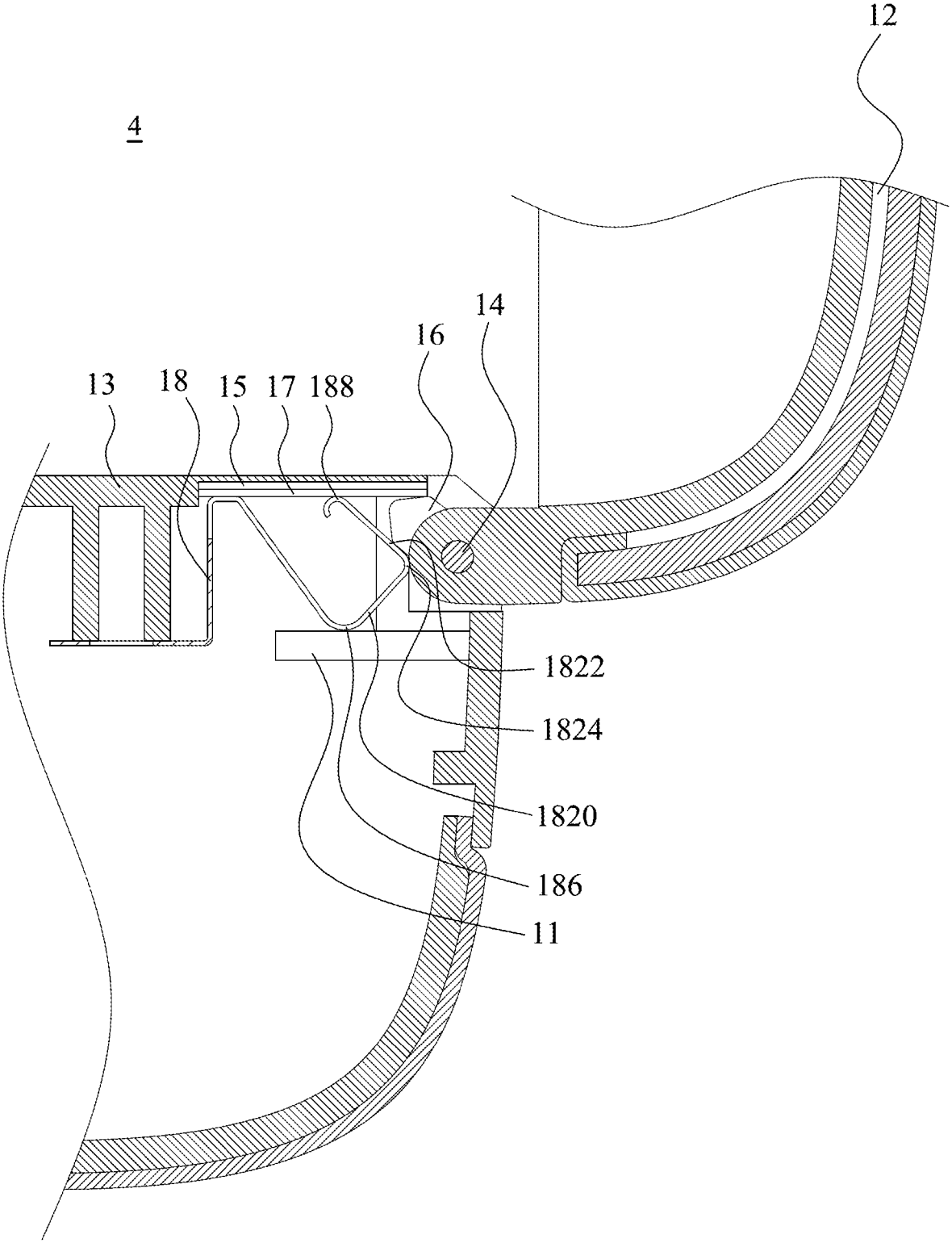
FIG. 6 illustrates a partial cross-sectional view of another container according to some embodiments of the present disclosure.

Reference is made to FIG. 6. FIG. 6 illustrates a partial cross-sectional view of a container 4 according to some embodiments of the present disclosure. As shown in FIG. 6, the container 4 includes the first cover 10, the second cover 12, the rotating shaft 14, the acting portion 16 disposed on the rotating shaft 14, the multiple bending elastic piece 18 located in the first cover 10, the first limiting plate 11, and the second limiting plate 13. The structures and functions of the components and their relationships are substantially the same as those of the container 1 shown in FIGS. 1A to 4, and the related detailed descriptions may refer to the foregoing paragraphs, and are not described again herein.

It is noted that, the difference between the present embodiment and the embodiment in FIGS. 1A to 4 is that the buffering layer 15 and the protecting layer 17 are disposed on the second limiting plate 13. Specifically, the buffering layer 15 is disposed between the protecting layer 17 and the second limiting plate 13. The buffering plate 15 can be used to prevent the abutting portion 188 and/or the acting portion 16 from colliding with the second limiting plate 13 and generating noise. The protecting layer 17 can be used to prevent possible wear on the abutting portion 188 and/or the acting portion 16 when the top portion 188 and/or the action portion 16 collides with the second limit plate 13.

In some embodiments, the buffering layer 15 and the protecting layer 17 can also be selectively disposed on the first limiting plate 11, and the buffering layer 15 is further disposed between the protecting layer 17 and the first limiting plate 11.

Figure 7A:
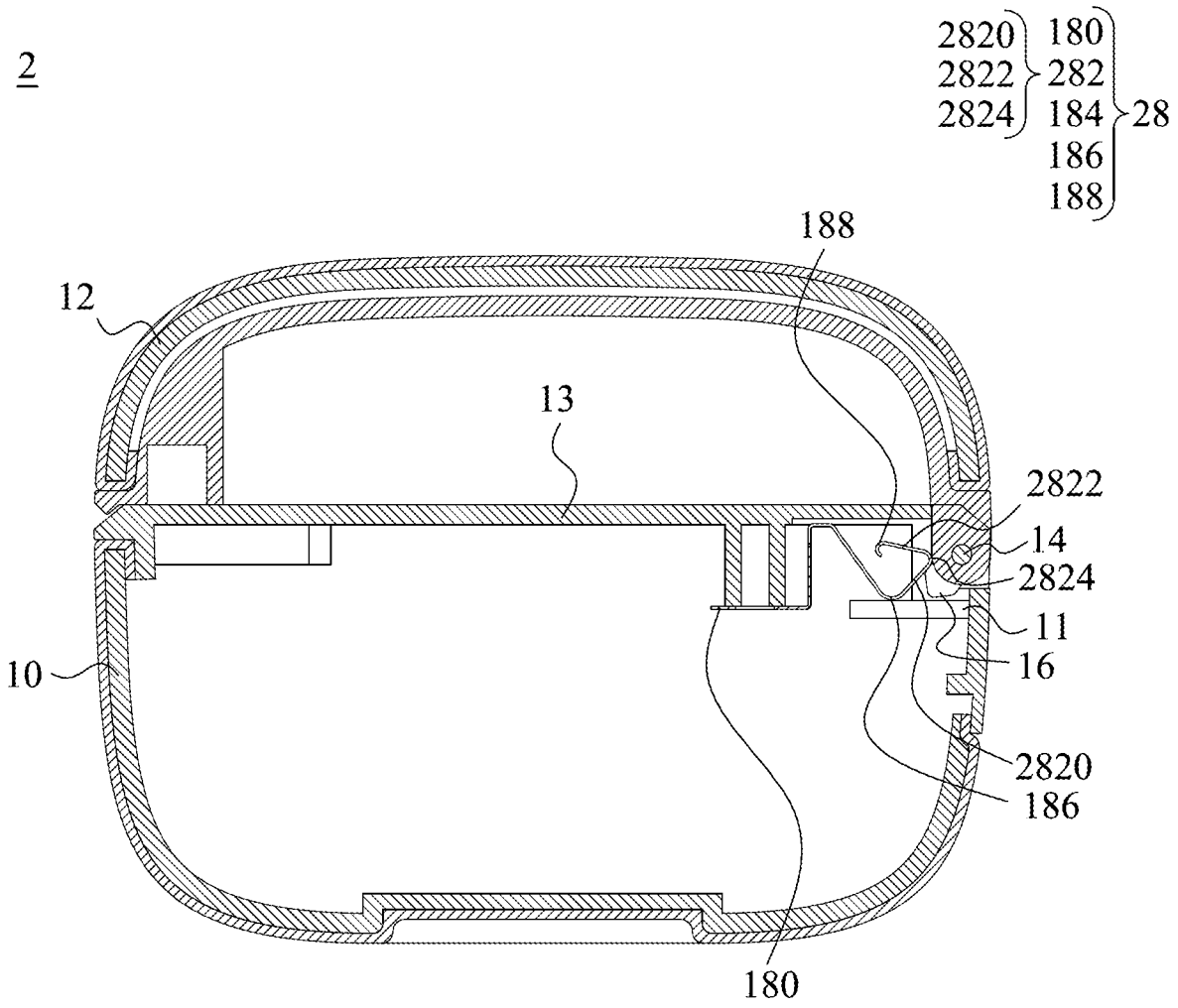
FIG. 7A and FIG. 7B illustrate cross-sectional views of another container at different stages of operation according to some embodiments of the present disclosure, in which the second cover shown in FIG. 7A covers the first cover, and the second cover shown in FIG. 7B is opened relative to the first cover.
Figure 7B:
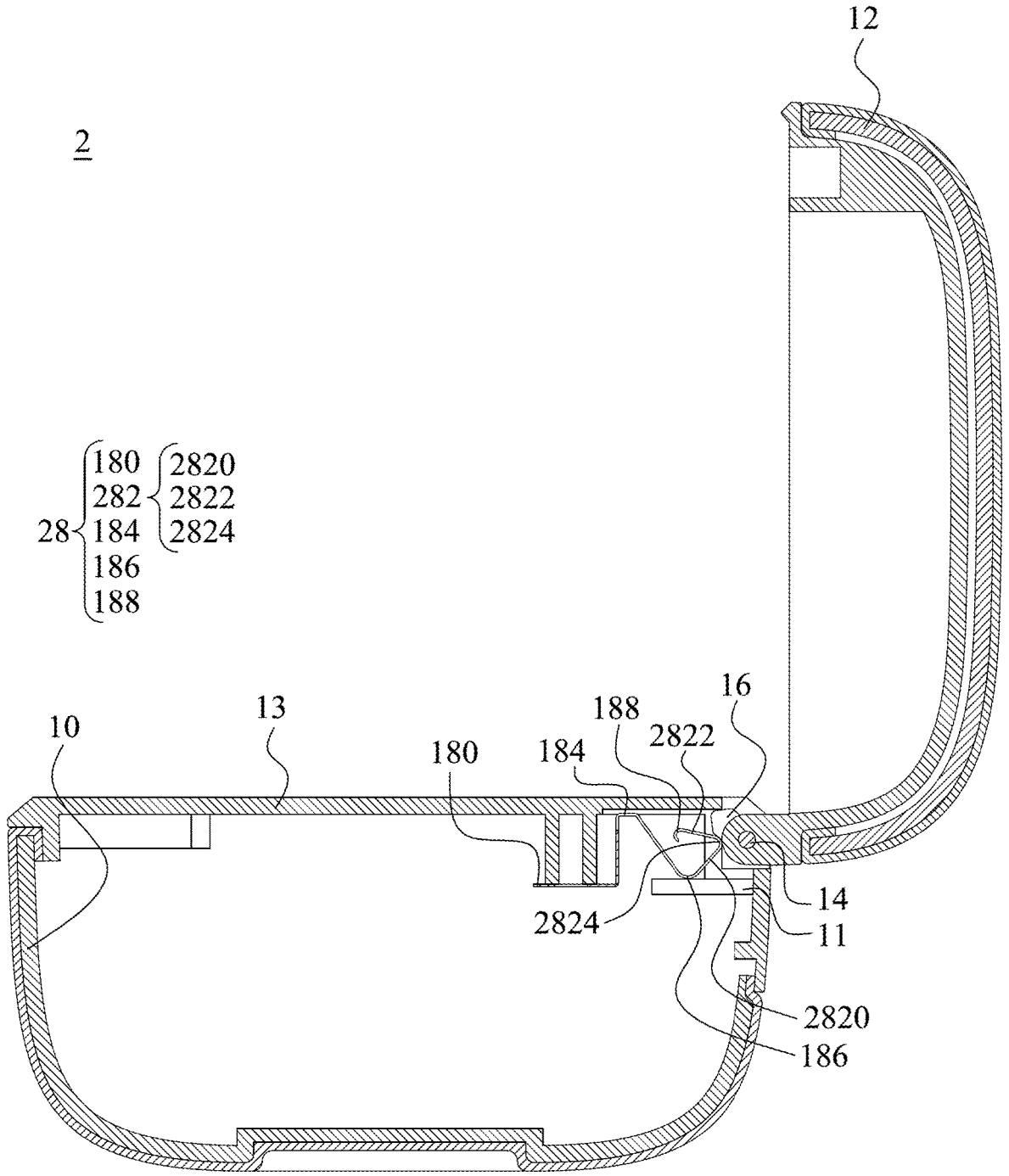

Reference is made to FIG. 7A and FIG. 7B. FIG. 7A and FIG. 7B illustrate cross-sectional views of a container 2 according to some embodiments of the present disclosure, in which the second cover 12 shown in FIG. 7A covers the first cover 10, and the second cover 12 shown in FIG. 7B is opened relative to the first cover 10. As shown in FIG. 7A and FIG. 7B, the container 2 includes the first cover 10, the second cover 12, the rotating shaft 14, the acting portion 16 disposed on the rotating shaft 14, the multiple bending elastic piece 28 located in the first cover 10, the first limiting plate 11, and the second limiting plate 13. The structure and function of the components and their relationships are substantially the same as the container 1 shown in FIGS. 1A to 4, and the related detailed descriptions may refer to the foregoing paragraphs, and are not described again herein.

It is noted that, the difference between the present embodiment and the embodiment in FIGS. 1A to 4 is that an interfering portion 282 of the multiple bending elastic piece 28 includes a first elastic segment 2820, a turning corner 2824, and a second elastic segment 2822. An angle between the first elastic segment 2820 and the second elastic segment 2822 is less than the angle A2 between the first elastic segment 1820 and the second elastic segment 1822 in FIG. 1B. Hence, the multiple bending elastic piece 18 shown in FIG. 1A to FIG. 4 is replaced by the multiple bending elastic piece 28. In the present embodiment, the angle between the first elastic segment 2820 and the second elastic segment 2822 can be about 60 degrees, but the present disclosure is not limited thereto.

Figure 8A:
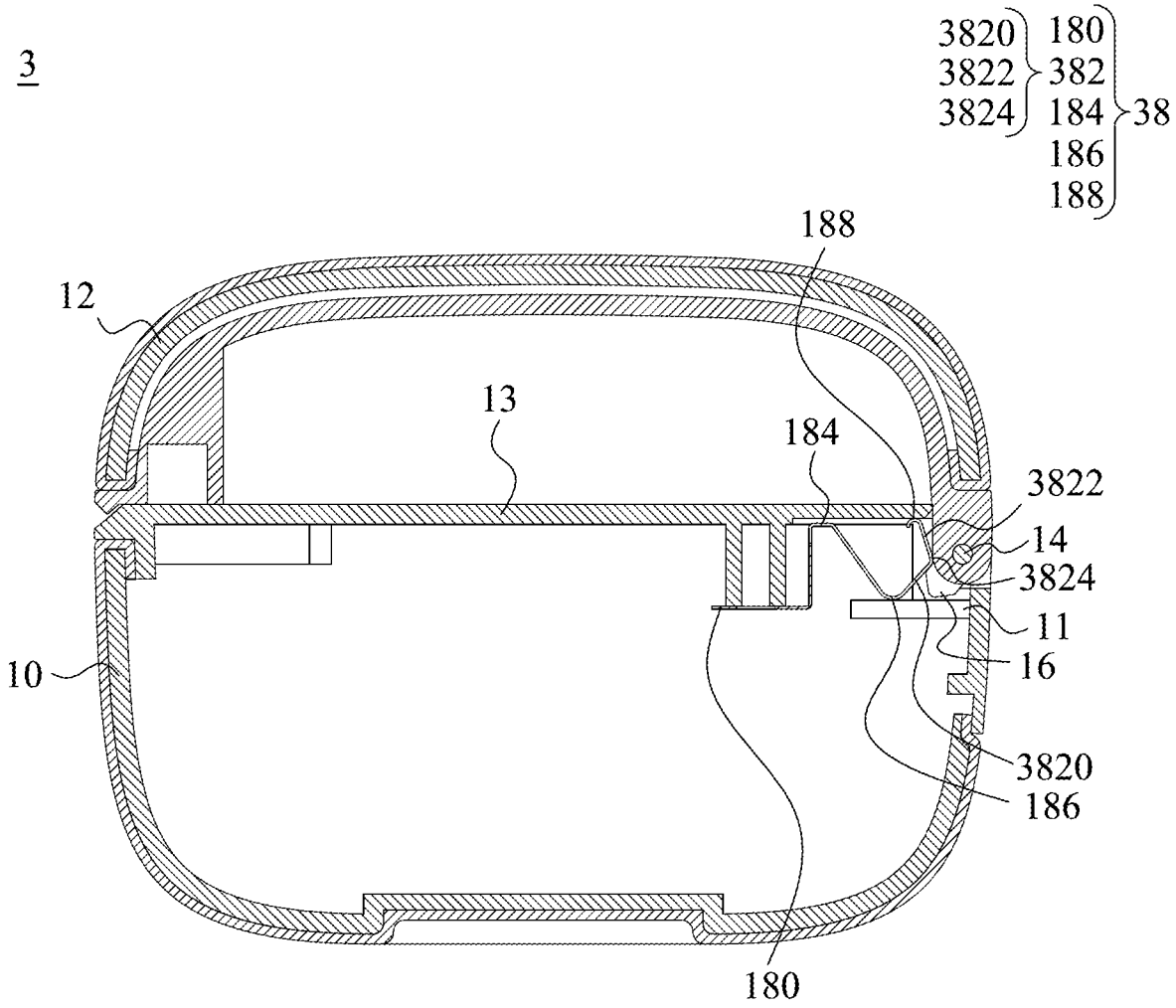
FIG. 8A and FIG. 8B illustrate cross-sectional views of another container at different stages of operation according to some embodiments of the present disclosure, in which the second cover shown in FIG. 8A covers the first cover, and the second cover shown in FIG. 8B is opened relative to the first cover.
Figure 8B:
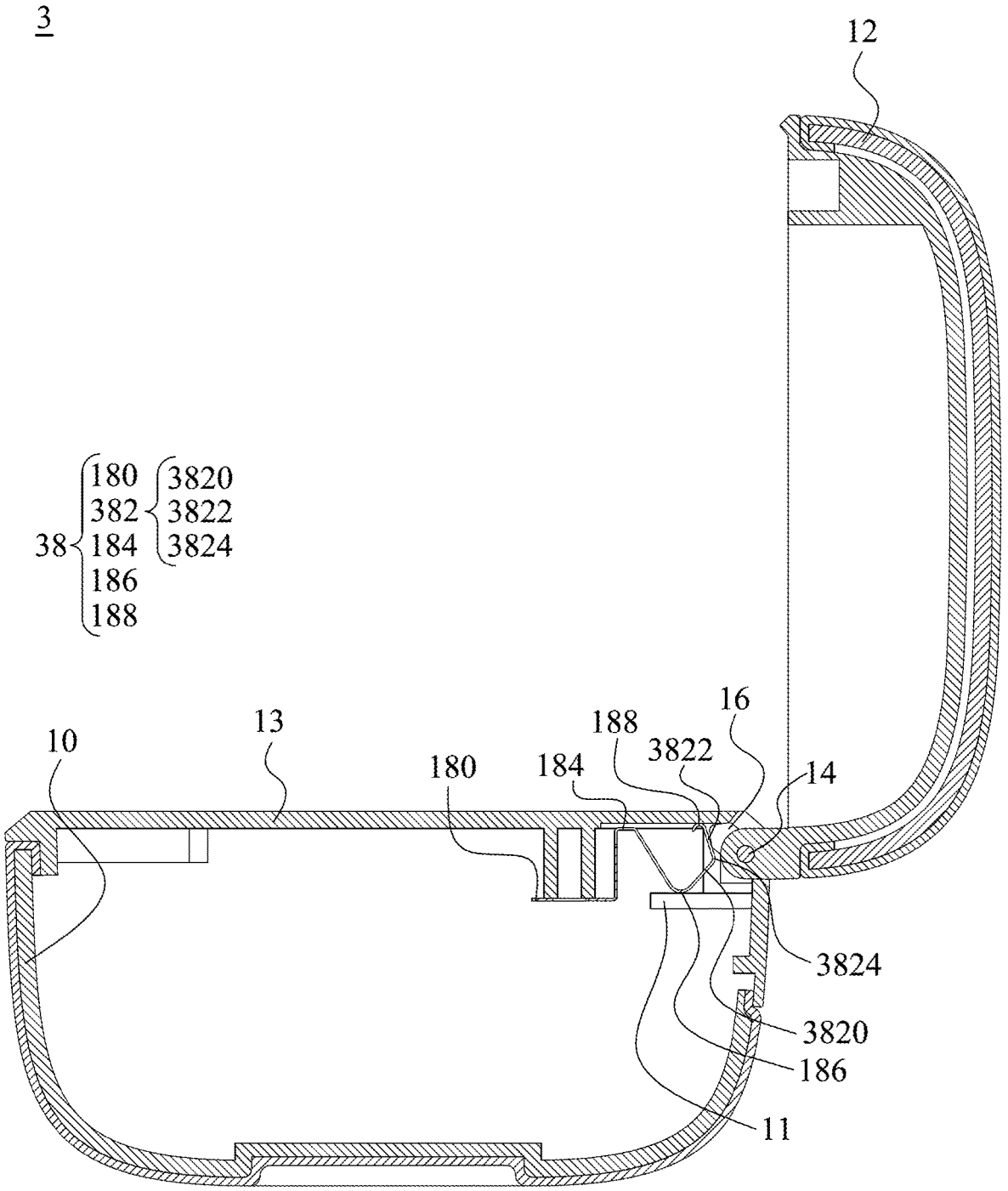

Reference is made to FIG. 8A and FIG. 8B. FIG. 8A and FIG. 8B illustrate cross-sectional views of a container 3 according to some embodiments of the present disclosure, in which the second cover 12 shown in FIG. 8A covers the first cover 10, and the second cover 12 shown in FIG. 8B is opened relative to the first cover 10. As shown in FIG. 8A and FIG. 8B, the container 3 includes the first cover 10, the second cover 12, the rotating shaft 14, the acting portion 16 disposed on the rotating shaft 14, the multiple bending elastic piece 38 located in the first cover 10, the first limiting plate 11, and the second limiting plate 13. The structure and function of the components and their relationships are substantially the same as the container 1 shown in FIGS. 1A to 4, and the related detailed descriptions may refer to the foregoing paragraphs, and are not described again herein.

It is noted that, the difference between the present embodiment and the embodiment in FIGS. 1A to 4 is in that an interfering portion 382 of the multiple bending elastic piece 38 includes a first elastic segment 3820, a turning corner 3824, and a second elastic segment 3822. An angle between the first elastic segment 3820 and the second elastic segment 3822 is greater than the angle A2 between the first elastic segment 1820 and the second elastic segment 1822 in FIG. 1B. Hence, the multiple bending elastic piece 18 shown in FIG. 1A to FIG. 4 is replaced by the multiple bending elastic piece 38. In the present embodiment, the angle between the first elastic segment 3820 and the second elastic segment 3822 can be about 120 degrees, but the present disclosure is not limited thereto.

According to the foregoing embodiments of the disclosure, it can be seen that, a multiple bending elastic piece in the container is not deformed when the container is not opened. At this time, the acting portion is interposed between the first elastic segment and the second limiting plate of the multiple bending, thereby restricting rotation of a rotating shaft relative to a first cover. Hence, a second cover is positioned at a cover position with respect to the first cover.

When the acting portion rotates toward the second limiting plate, a interfering portion of the multiple bending elastic piece presses the acting portion, so that the acting portion automatically rotates toward the second limiting plate, thereby driving the rotating shaft to rotate, such that the second cover connected to the rotating shaft in the container can be automatically opened relative to the first cover. Furthermore, when the second cover of the container is rotated to be opened relative to the first cover, the interfering portion presses the acting portion, so that the acting portion is sandwiched between the second elastic segment of the multiple bending elastic piece and the second limiting plate, thereby limiting the rotation of the rotating shaft relative to the first cover. Hence, the second cover connected to the rotating shaft is positioned in the open position relative to the first cover body.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A container, comprising:

a first cover;

a second cover;

a rotating shaft engaged between the first cover and the second cover, such that the first cover and the second cover are rotatable relative to each other;

an acting portion connected to the rotating shaft;

a multiple bending elastic piece comprising a fixing portion fixed to the first cover, an interfering portion located between the fixing portion and the rotating shaft, and an abutting portion connected to the interfering portion, wherein, while the rotating shaft is rotating relative to the first cover, the acting portion changes a bending degree of the multiple bending elastic piece with the rotation of the rotating shaft, thereby enabling the interfering portion to selectively contact opposite sides of the acting portion;

a limiting plate covering the acting portion and the interfering portion, wherein the abutting portion of the multiple bending elastic piece is located closer to the limiting plate than the interfering portion; and a buffering layer disposed on the abutting portion of the multiple bending elastic piece and located between the abutting portion and the limiting plate.

2. The container of claim 1, wherein each of the opposite sides of the acting portion has at least two adjacent planes, and the at least two adjacent planes at one of the opposite sides of the acting portion are symmetric to the at least two planes at the other of the opposite sides of the acting portion respectively.

3. The container of claim 2, wherein the at least two adjacent planes intersect at an angle in a range substantially from 60 degrees to 120 degrees.

4. The container of claim 1, wherein the interfering portion comprises a first elastic segment and a second elastic segment connected to the first elastic segment, the first elastic segment extends from the fixing portion to the rotating shaft, and the second elastic segment is folded away from an end of the first elastic segment near the rotating shaft and extends away from the rotating shaft.

5. The container of claim 4, wherein the first elastic segment and the second elastic segment form a V-shaped profile.

6. The container of claim 4, wherein the interfering portion further comprises a turning corner connected between the first elastic segment and the second elastic segment.

7. The container of claim 1, wherein the buffering layer has an opening that exposes a part of the interfering portion.

8. The container of claim 1, further comprising a protecting layer disposed on the interfering portion and located between the interfering and the acting portion.

9. The container of claim 8, wherein the protecting layer has an opening that exposes a part of the interfering portion.

10. A container, comprising:

a first cover;

a second cover;

a rotating shaft engaged between the first cover and the second cover, such that the first cover and the second cover are rotatable relative to each other;

an acting portion connected to the rotating shaft;

a multiple bending elastic piece comprising a fixing portion fixed to the first cover, an interfering portion located between the fixing portion and the rotating shaft, and an abutting portion connected to the interfering portion, wherein, while the rotating shaft is rotating relative to the first cover, the acting portion changes a bending degree of the multiple bending elastic piece with the rotation of the rotating shaft, thereby enabling the interfering portion to selectively contact opposite sides of the acting portion;

a limiting plate covering the acting portion and the interfering portion, wherein the abutting portion of the multiple bending elastic piece is located closer to the limiting plate than the interfering portion; and a buffering layer disposed on the limiting plate and located between the abutting portion of the multiple bending elastic piece and the limiting plate.

* * * * *